US011045776B2

(12) United States Patent
Zhang et al.

(10) Patent No.: US 11,045,776 B2
(45) Date of Patent: Jun. 29, 2021

(54) METHODS AND SYSTEMS FOR A FUEL INJECTOR

(71) Applicant: Ford Global Technologies, LLC, Dearborn, MI (US)

(72) Inventors: Xiaogang Zhang, Novi, MI (US); Joseph Basmaji, Waterford, MI (US); Jianwen James Yi, West Bloomfield, MI (US); Mark Meinhart, Dexter, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 310 days.

(21) Appl. No.: 16/109,383

(22) Filed: Aug. 22, 2018

(65) Prior Publication Data

US 2020/0061554 A1 Feb. 27, 2020

(51) Int. Cl.

| | |
|---|---|
| ***B01F 5/00*** | (2006.01) |
| ***B01F 5/04*** | (2006.01) |
| ***F02M 61/18*** | (2006.01) |

(52) U.S. Cl.

CPC ..... *B01F 5/0426* (2013.01); *F02M 61/18* (2013.01); *B01F 2005/0438* (2013.01); *F02M 2200/06* (2013.01); *F02M 2700/4376* (2013.01)

(58) Field of Classification Search

CPC ..... B01F 5/0057; B01F 5/0426; B01F 2005/0438; F02M 61/18; F02M 61/1813; F02M 2200/06; F02M 2700/4376

See application file for complete search history.

(56) References Cited

U.S. PATENT DOCUMENTS

| | | | | |
|---|---|---|---|---|
| 4,044,077 | A * | 8/1977 | Gupta | F02M 9/02 261/23.2 |
| 4,408,722 | A | 10/1983 | Frelund | |
| 4,895,184 | A | 1/1990 | Abbey | |
| 4,974,416 | A | 12/1990 | Taylor | |
| 5,170,942 | A * | 12/1992 | Spink | B05B 7/08 239/427.3 |
| 5,431,346 | A | 7/1995 | Sinaisky | |
| 5,707,012 | A | 1/1998 | Maier et al. | |
| 5,966,937 | A | 10/1999 | Graves | |
| 6,042,028 | A | 3/2000 | Xu | |
| 6,045,063 | A | 4/2000 | Koike et al. | |
| 6,065,691 | A | 5/2000 | West | |
| 6,253,555 | B1 | 7/2001 | Willis | |
| 6,817,545 | B2 | 11/2004 | Xu | |
| 8,622,715 | B1 | 1/2014 | Lott et al. | |
| 9,587,606 | B2 | 3/2017 | Anders et al. | |

(Continued)

FOREIGN PATENT DOCUMENTS

| | | | |
|---|---|---|---|
| EP | 2400220 | A2 | 12/2011 |
| WO | 2004042221 | A2 | 5/2004 |

OTHER PUBLICATIONS

Zhang, X. et al., "Fuel Injector," U.S. Appl. No. 15/841,036, filed Dec. 13, 2017, 23 pages.

*Primary Examiner* — Anshu Bhatia

(74) *Attorney, Agent, or Firm* — Geoffrey Brumbaugh; McCoy Russell LLP

(57) ABSTRACT

Methods and systems are provided for a fuel injector. In one example, a system may include an injection nozzle having a venturi shape with an upstream twisted fin arranged in a venturi inlet. The system may further include a downstream twisted fin arranged in a venturi outlet.

18 Claims, 7 Drawing Sheets

(56) References Cited

U.S. PATENT DOCUMENTS

| | | | | |
|---|---|---|---|---|
| 10,077,724 | B1 | 9/2018 | Kurtz et al. | |
| 2008/0280238 | A1* | 11/2008 | Smith | F23R 3/286 431/9 |
| 2012/0266064 | A1* | 10/2012 | Maguire | H04L 67/04 715/255 |

* cited by examiner

METHODS AND SYSTEMS FOR A FUEL INJECTOR

FIELD

The present description relates generally to a fuel injector comprising one or more features to decrease soot formation.

BACKGROUND/SUMMARY

In engines, air is drawn into a combustion chamber during an intake stroke by opening one or more intake valves. Then, during the subsequent compression stroke, the intake valves are closed, and a reciprocating piston of the combustion chamber compresses the gases admitted during the intake stroke, increasing the temperature of the gases in the combustion chamber. Fuel is then injected into the hot, compressed gas mixture in the combustion chamber. The mixture may be ignited via a spark or upon reaching a threshold pressure. The combusting air-fuel mixture pushes on the piston, driving motion of the piston, which is then converted into rotational energy of a crankshaft.

However, the inventors have recognized potential issues with such engines. As one example, fuel may not mix evenly with the air in the combustion chamber, leading to the formation of dense fuel pockets in the combustion chamber. These dense regions of fuel may produce soot as the fuel combusts. As such, engines may include particulate filters for decreasing an amount of soot and other particulate matter in their emissions. However, such particulate filters lead to increased manufacturing costs and increased fuel consumption during active regeneration of the filter.

Modern technologies for combating engine soot output and poor air/fuel mixing may include features for entraining air with the fuel prior to injection. This may include passages arranged in an injector body, as an insert into the engine head deck surface, or integrated in an engine head. Ambient air mixes with the fuel, cooling the injection temperature, prior to delivering the mixture to the compressed air in the cylinder. By entraining cooled air with the fuel prior to injection, a lift-off length is lengthened and start of combustion is retarded. This limits soot production through a range of engine operating conditions, reducing the need for a particulate filter.

However, the inventors herein have recognized potential issues with such injectors. As one example, the previously described fuel injectors may no longer sufficiently prevent soot production to a desired level in light of increasingly stringent emissions standards. Additionally, the previously described fuel injectors may only limit soot production in diesel engines, where air/fuel have a longer duration of time to mix before combustion than in spark-ignited engines.

In one example, the issues described above may be addressed by a system comprising an injector having a venturi-shaped nozzle, wherein the nozzle comprises a plurality of upstream twisted fins arranged in a venturi inlet of the nozzle, and where a leading edge of an upstream twisted fin of the plurality of upstream twisted fins is perpendicular to a trailing edge of the twisted fin. In this way, a swirl may be imparted onto a fuel mixture, which may improve mixing between the various fuel components and air and exhaust gases.

As one example, the injector may further comprise downstream twisted fins arranged in a venturi outlet. The downstream and upstream twisted fins may be similarly shaped, however, the fins may be offset to one another relative to a general direction of a fuel mixture flow. This may increase a likelihood of the fuel mixture contacting at least one of the upstream or downstream twisted fins. By doing this, soot production of the engine may be prevented and/or mitigated to an extent such that a particulate filter may be omitted from an exhaust system.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-5 are shown approximately to scale, although other relative dimensions may be used, if desired.

DETAILED DESCRIPTION

Figure 2:
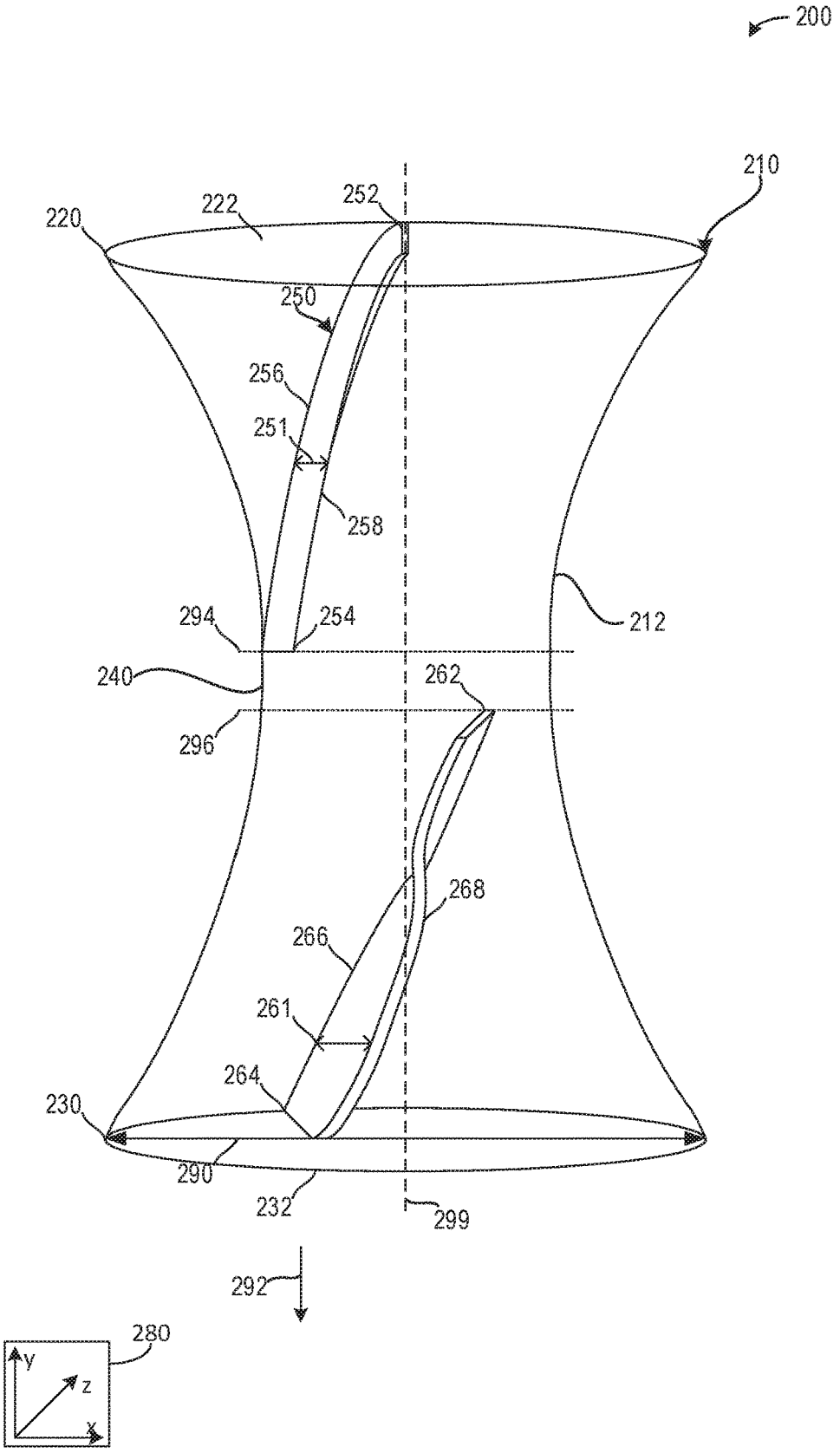
FIG. 2 shows an example of a single injector nozzle.
Figure 3A:
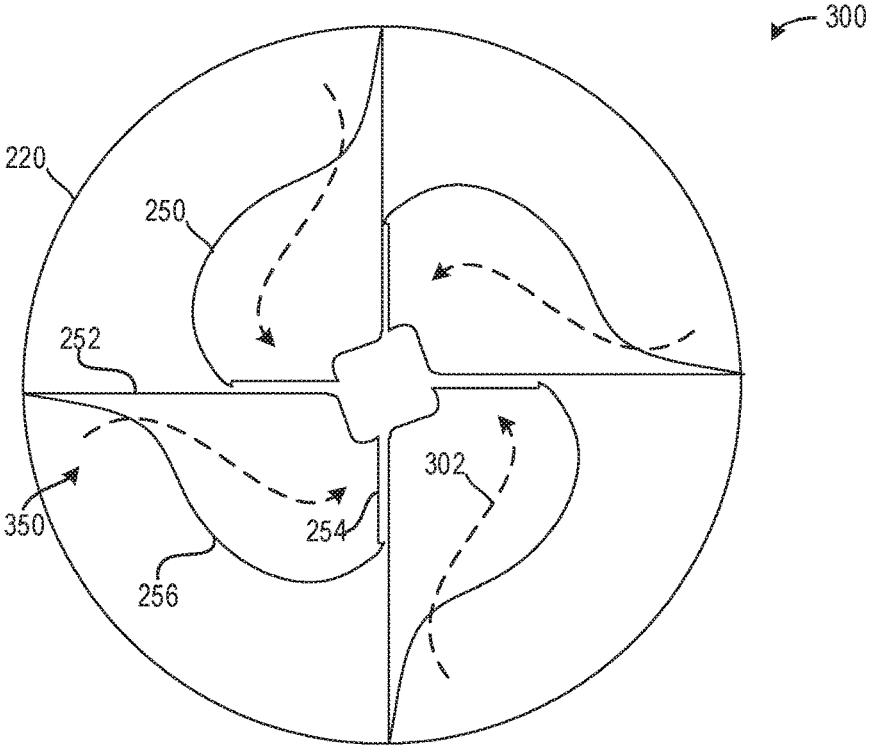
FIGS. 3A and 3B show a view of the upstream fins and the downstream fins, respectively.
Figure 3B:
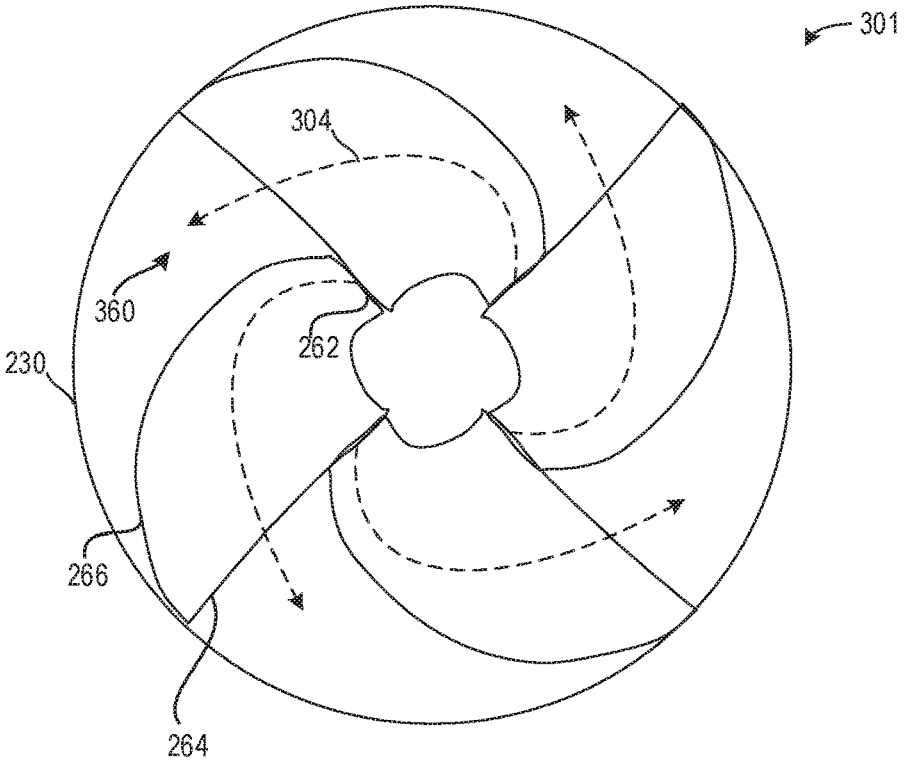
Figure 4:
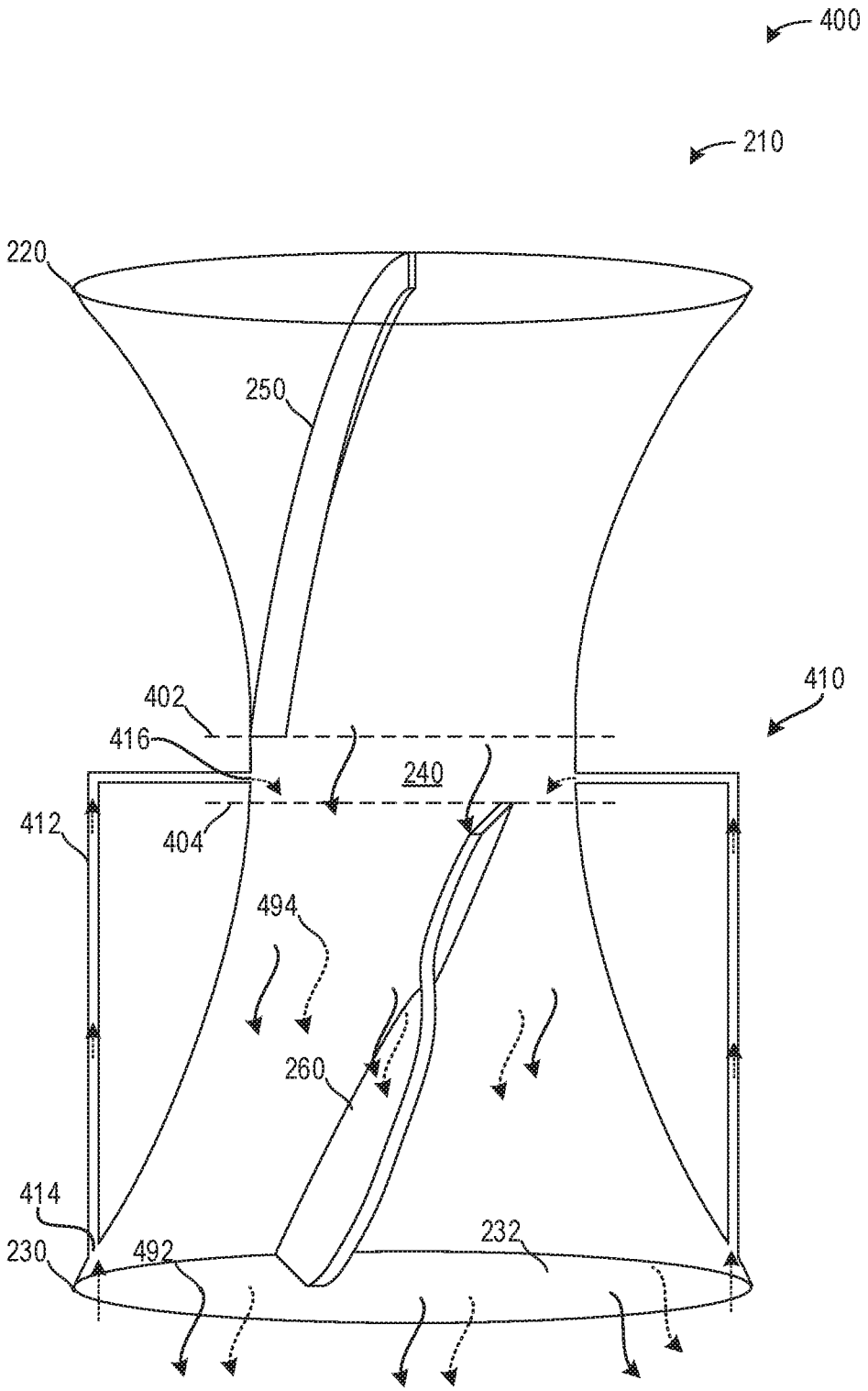
FIG. 4 shows an example of a first embodiment of an air entrainment system being included with the injector nozzle.
Figure 5:
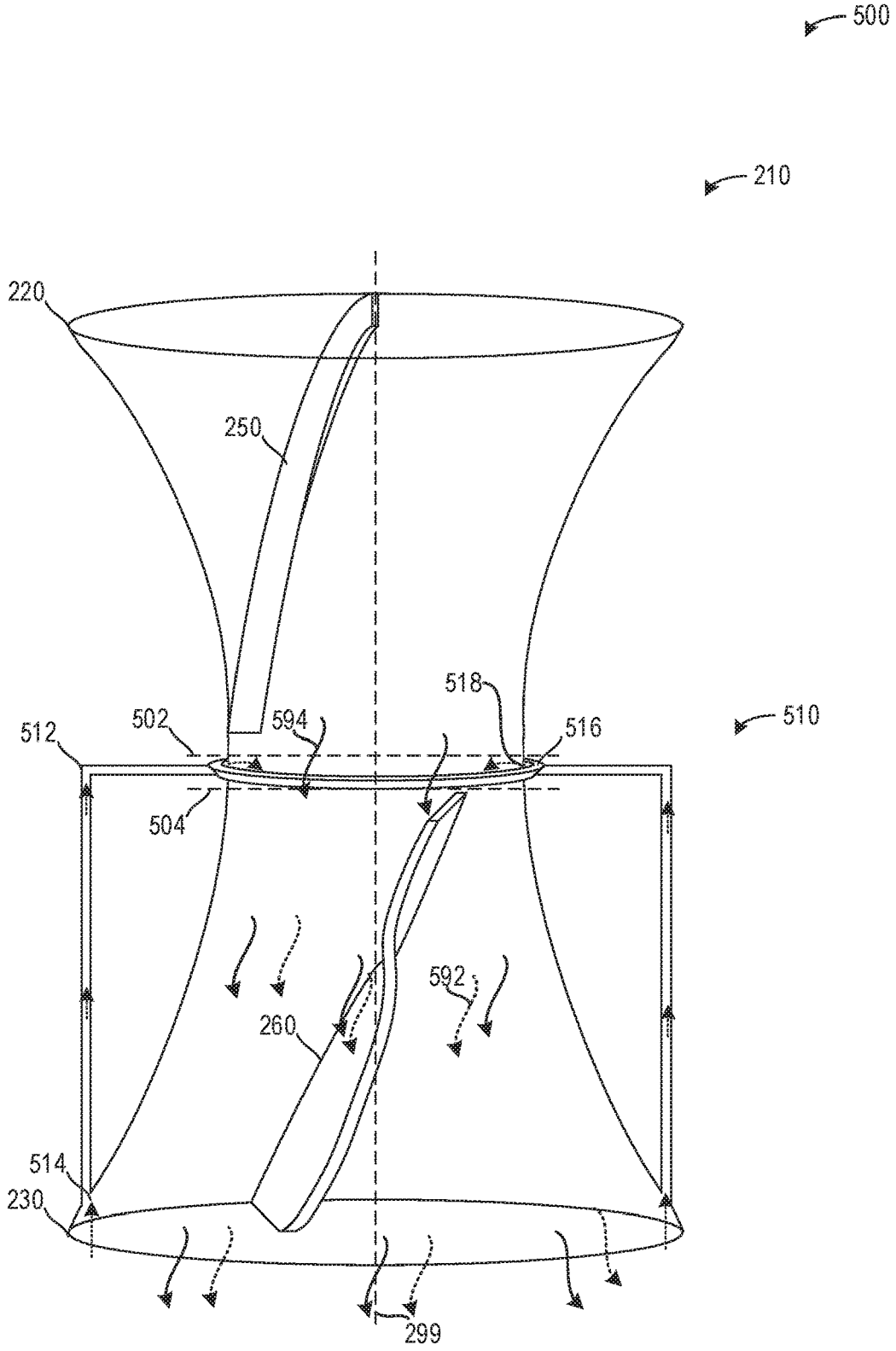
FIG. 5 shows an example of a second embodiment of an air entrainment system being included with the injector nozzle.
Figure 6A:
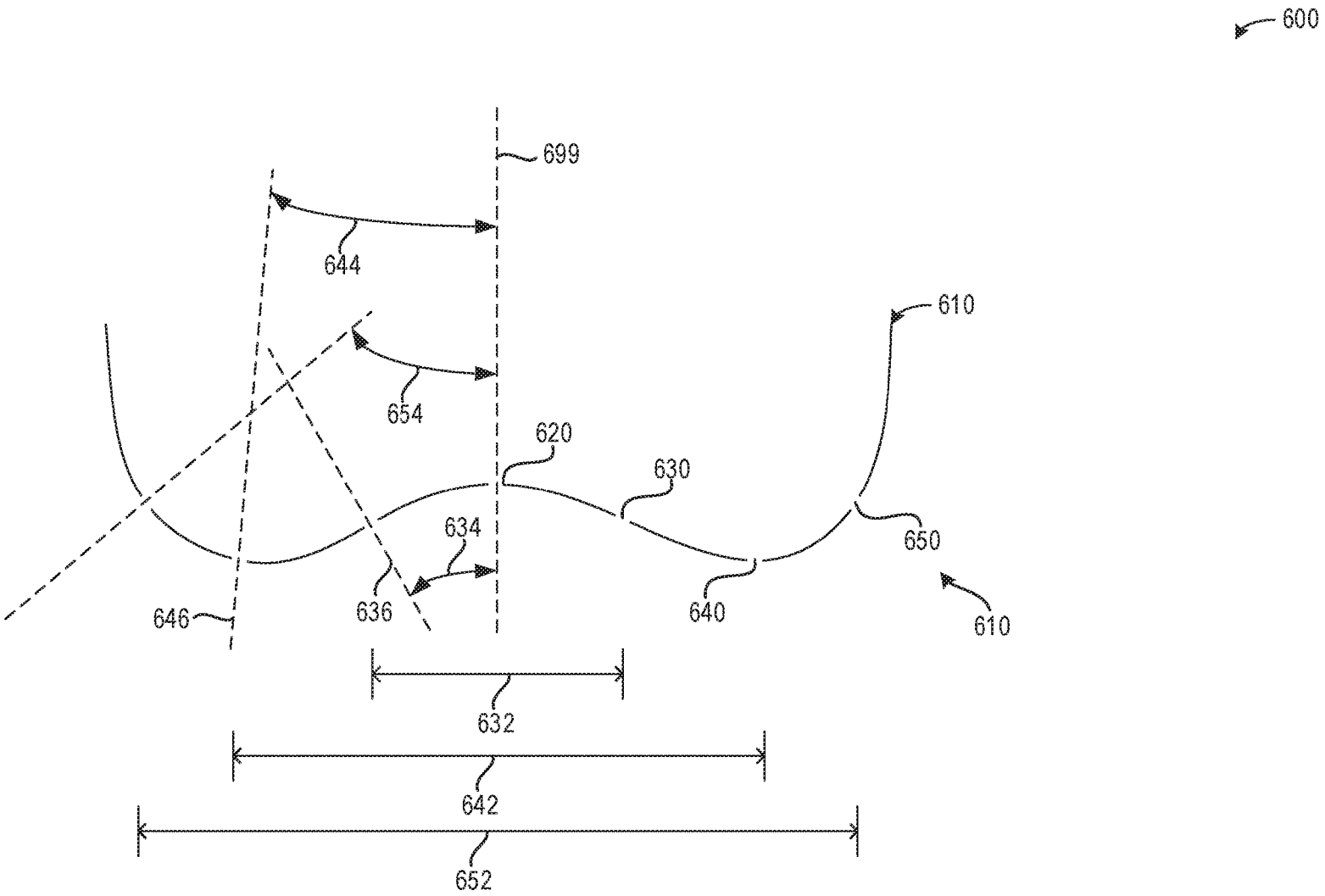
FIGS. 6A and 6B show an example of an injector tip comprising a curved shape to angle its nozzles, wherein the nozzles may include the nozzles of FIGS. 2, 3A, 3B, 4, and 5.
Figure 6B:
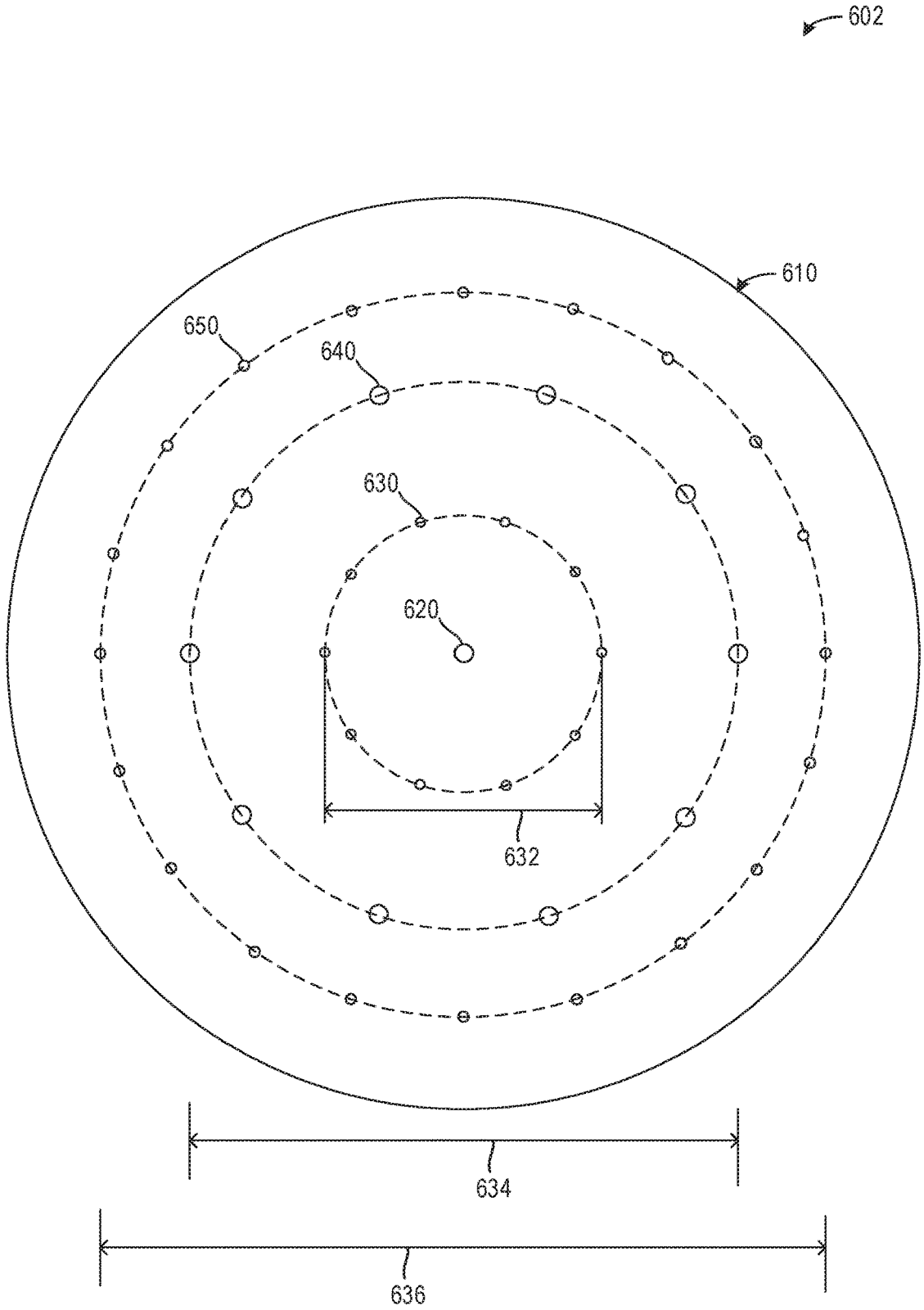

The following description relates to an injector nozzle having various features for promoting more complete combustion to decrease soot production from an engine. The engine may be arranged in a hybrid vehicle, such as the hybrid vehicle illustrated in FIG. 1. The injector may be a fuel injector in one example, however, it will be appreciated that the injector may inject other types and/or mixtures of liquids without departing from the scope of the present disclosure, wherein the liquids may include water, alcohol, reductants, bases, acids, catalysts, and the like. Additionally, the injector may be shaped to mix gases. The injector may comprise a venturi shape, wherein a venturi inlet and a venturi outlet may optionally comprise one or more features to promote a fuel mixture to swirl. More specifically, the venturi inlet may comprise one or more upstream fins, as shown in FIGS. 2 and 3A. Additionally, the venturi outlet may comprise one or more downstream fins, as shown in FIGS. 2 and 3B. The injector nozzle may further comprise a first embodiment of an air entrainment system, as shown in FIG. 4, or a second embodiment of an air entrainment system, as shown in FIG. 5, where the systems may direct combustion chamber gases to flow to a venturi throat of the nozzle to further increase mixing between the fuel mixture and the combustion chamber gases, which may adjust combustion conditions to conditions where soot may not be produced. FIGS. 6A and 6B show an example of an injector tip comprising a curved surface with a plurality of nozzle groups arranged circularly at different diameters. Due to the curvature of the injector tip, the nozzles of the various groups may be angled differently relative to a central axis of the injector. FIGS. 2-5 are shown approximately to scale, although other relative dimensions may be used, if desired.

FIGS. 1-6B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Note that FIGS. 3A, 3B, 4, and 5 show arrows indicating where there is space for gas to flow, and the solid lines of the device walls show where flow is blocked and communication is not possible due to the lack of fluidic communication created by the device walls spanning from one point to another. The walls create separation between regions, except for openings in the wall which allow for the described fluid communication.

Figure 1:
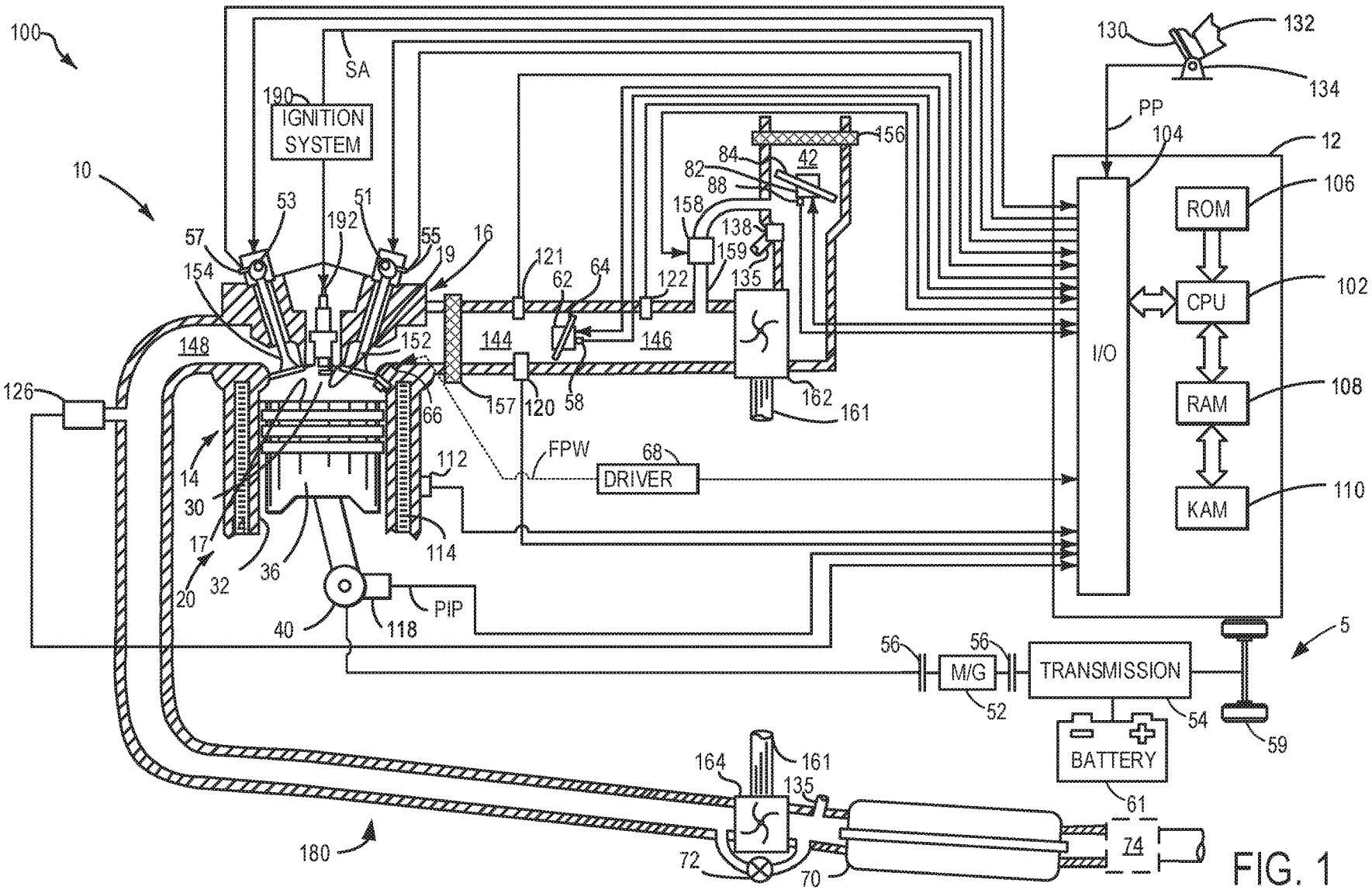
FIG. 1 shows an engine of a hybrid vehicle.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. The cylinder bore 20 may be defined as the volume enclosed by the cylinder walls 32. The cylinder head 16 may be coupled to the cylinder block 14, to enclose the cylinder bore 20. Thus, when coupled together, the cylinder head 16 and cylinder block 14 may form one or more combustion chambers. In particular, combustion chamber 30 may be the volume included between a top surface 17 of the piston 36 and a fire deck 19 of the cylinder head 16. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore 20 may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such may the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

The cylinder walls 32, piston 36, and cylinder head 16 may thus form the combustion chamber 30, where a top surface 17 of the piston 36 serves as the bottom wall of the combustion chamber 30 while an opposed surface or fire deck 19 of the cylinder head 16 forms the top wall of the combustion chamber 30. Thus, the combustion chamber 30 may be the volume included within the top surface 17 of the piston 36, cylinder walls 32, and fire deck 19 of the cylinder head 16.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection 30. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

In some examples, the injector 66 may comprise one or more features to reduce the temperature of air that is entrained by the fuel injected from the injector 66. Specifically, when fuel exits the injector 66 during fuel injection, it may travel a distance while mixing with air in a nozzle before combusting. In the description herein, the distance the fuel spray travels before combusting may be referred to as the "lift-off length." In particular, the lift-off length may refer to the distance the injected fuel travels before the combustion process begins. Thus, the lift-off length may be a distance between an orifice of the injector 66 from which the fuel exits the injector 66, to a point in the combustion chamber 30 at which combustion of the fuel occurs.

The injector 66 may decrease the temperature of the gases that mix with the fuel prior to combustion in the combustion chamber 30. Furthermore, the injector 66 may enable a higher spray velocity, within and at a nozzle of the injector 66, thereby increasing air entrainment with the fuel injection and fuel penetration into the combustion chamber 30. In this way, the lift-off length of the fuel spray may be increased and/or an amount of air entrainment in the fuel spray may be increased. The nozzle may be in fluidic communication with combustion chamber 30, such that gases in the combustion chamber 30 may enter the one or more flow-through passages of the nozzle and be recirculated back into the combustion chamber 30. As one example, intake air, and/or exhaust gas, introduced into the combustion chamber 30 during an intake stroke, may be pushed into the nozzle during all or a portion of the compression stroke.

Intake manifold 144 is shown communicating with optional electronic throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from downstream of charge air cooler 157 to the compressor inlet. In alternate examples, compressor recirculation path 159 may be configured to recirculate compressed air from downstream of the compressor and upstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Emission control device may be a catalytic converter and as such may also be referred to herein as catalytic converter 70. Alternatively, a two-state exhaust gas oxygen sensor may be substituted for UEGO sensor 126. Converter 70 may include multiple catalyst bricks, in one example. In another example, multiple emission control devices, each with multiple bricks, can be used. Converter 70 can be a three-way type catalyst in one example. While the depicted example shows UEGO sensor 126 upstream of turbine 164, it will be appreciated that in alternate embodiments, UEGO sensor may be positioned in the exhaust manifold downstream of turbine 164 and upstream of convertor 70. Additionally or alternatively, the converter 70 may comprise a diesel oxidation catalyst (DOC) and/or a diesel cold-start catalyst.

In some examples, a particulate filter (PF) 74 may be coupled downstream of the emission control device 70 to trap soot in a direction of exhaust gas flow. In some examples, there may exist a selective catalytic reduction device and/or a lean $NO_x$ trap between the converter 70 and the PF 74. The PF 74 may be manufactured from a variety of materials including cordierite, silicon carbide, and other high temperature oxide ceramics. The PF 74 may be periodically regenerated in order to reduce soot deposits in the filter that resist exhaust gas flow. Filter regeneration may be accomplished by heating the filter to a temperature that will burn soot particles at a faster rate than the deposition of new soot particles, for example, 400-600° C.

However, in other examples, due to the inclusion of mixing and air entrainment features in at least one nozzle of the fuel injector 66, PF 74 may not be included in the engine 10. As such soot production during the combustion cycle may be reduced. In some examples, soot levels may be reduced to approximately zero due to the increased commingling of fuel and air prior to combustion/ignition of the mixture in the combustion chamber 30. As such, approximately no soot (e.g., zero soot) may be produced by engine 10 during the combustion cycle in some examples. In other examples, due to the features of the injector, soot production may be reduced and as such, the PF 74 may be regenerated less frequently, reducing fuel consumption.

During the combustion cycle, each cylinder within engine 10 may undergo a four stroke cycle including: an intake stroke, compression stroke, power stroke, and exhaust stroke. During the intake stroke and power stroke, the piston 36 moves away from the cylinder head 16 towards a bottom of the cylinder increasing the volume between the top of the piston 36 and the fire deck 19. The position at which piston 36 is near the bottom of the cylinder and at the end of its intake and/or power strokes (e.g., when combustion chamber 30 is at its largest volume) is typically referred to by those of skill in the art as bottom dead center (BDC). Conversely, during the compression and exhaust strokes, the piston 36 moves away from BDC towards a top of the cylinder (e.g., fire deck 19), thus decreasing the volume between the top of the piston 36 and the fire deck 19. The position at which piston 36 is near the top of the cylinder and at the end of its compression and/or exhaust strokes (e.g., when combustion chamber 30 is at its smallest volume) is typically referred to by those of skill in the art as top dead center (TDC). Thus, during the intake and power strokes, the piston 36 moves from TDC to BDC, and during the compression and exhaust strokes, the piston 36 moves from BDC to TDC.

Further, during the intake stroke, generally, the exhaust valves 154 close and the intake valves 152 open to admit intake air into the combustion chamber 30. During the compression stroke, both valves 152 and 154 may remain closed, as the piston 36 compresses the gas mixture admitted during the intake stroke. During the compression stroke, gases in the combustion chamber 30 may be pushed into the fuel injector 66 due to the positive pressure created by the piston 36 as it travels towards the injector 66. The gases from the combustion chamber 30 may dissipate heat through one or more of the cylinder head 16 and ambient air via conduction and/or convection. As such, the temperature of the gases in the injector 66 may be reduced relative to the temperature of the gases in the combustion chamber 30.

When the piston 36 is near or at TDC during the compression and/or power stroke, fuel is injected into the combustion chamber 30 by injector 66. During the ensuing power stroke, the valves 152 and 154 remain closed, as the expanding and combusting fuel and air mixture pushes the piston 36 towards BDC. In some examples, fuel may be injected prior to the piston 36 reaching TDC, during the compression stroke. However, in other examples, fuel may be injected when the piston 36 reaches TDC. In yet further examples, fuel may be injected after the piston 36 reaches TDC and begins to translate back towards BDC during the power stroke. In yet further examples, fuel may be injected during both the compression and power strokes.

Fuel may be injected over a duration. An amount of fuel injected and/or the duration over which fuel is injected may be varied via pulse width modulation (PWM) according to one or more linear or non-linear equations. Further, the injector 66 may include a plurality of injection orifices, and an amount of fuel injected out of each orifice may be varied as desired.

The injected fuel travels through a volume of the nozzle of the injector 66 before entering the combustion chamber 30. Said another way, the nozzle may include air passages and fuel passages for entraining air and fuel, wherein the passages are located inside the combustion chamber 30. However, the passages are defined by surfaces of the nozzle and fuel injector body and fuel and air flow through these passages before flowing outside of the nozzle and into the combustion chamber 30 to mix with unmixed combustion chamber gases. The flow of air and fuel through the nozzle will be described in greater detail below.

During the exhaust stroke, the exhaust valves 154 may open to release the combusted air-fuel mixture to exhaust manifold 148 and the piston 36 returns to TDC. Exhaust gases may continue to flow from the exhaust manifold 148, to the turbine 164 via exhaust passage 180.

Both the exhaust valves 154 and the intake valves 152 may be adjusted between respective closed first positions and open second positions. Further, the position of the valves 154 and 152 may be adjusted to any position between their respective first and second positions. In the closed first position of the intake valves 152, air and/or an air/fuel mixture does not flow between the intake manifold 144 and the combustion chamber 30. In the open second position of the intake valves 152, air and/or an air/fuel mixture flows between the intake manifold 144 and the combustion chamber 30. In the closed second position of the exhaust valves 154, air and/or an air fuel mixture does not flow between the combustion chamber 30 and the exhaust manifold 148. However, when the exhaust valves 154 is in the open second position, air and/or an air fuel mixture may flow between the combustion chamber 30 and the exhaust manifold 148.

Note that the above valve opening and closing schedule is described merely as an example, and that intake and exhaust valve opening and/or closing timings may vary, such as to provide positive or negative valve overlap, late intake valve closing, or various other examples.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 61. Electric machine 61 may be a motor or a motor/generator. Crankshaft 40 of engine 10 and electric machine 61 are connected via a transmission 54 to vehicle wheels 59 when one or more clutches 56 are engaged. In the depicted example, a first clutch 56 is provided between crankshaft 40 and electric machine 61, and a second clutch 56 is provided between electric machine 61 and transmission 54. Controller 12 may send a signal to an actuator of each clutch 56 to engage or disengage the clutch, so as to connect or disconnect crankshaft 40 from electric machine 61 and the components connected thereto, and/or connect or disconnect electric machine 61 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 61 receives electrical power from a traction battery 58 to provide torque to vehicle wheels 59. Electric machine 61 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, adjusting a fuel injection may include adjusting an actuator of the injector 66 to move to or away from a nozzle of the injector 66 so that fuel may flow to the combustion chamber 30.

Turning now to FIG. 2, it shows an embodiment 200 of a fuel injector nozzle 210 which may be arranged in a fuel injector, such as fuel injector 66 of FIG. 1. Additionally or alternatively, the fuel injector nozzle 210 may be arranged in a fuel injector positioned to inject from a fire deck (e.g., fire deck 19 of FIG. 1) and/or from a side wall of a combustion chamber (e.g., combustion chamber 30 of FIG. 1). The fuel injector nozzle 210 may be the only nozzle of a fuel injector or may be one of a plurality of similarly shaped nozzles of the fuel injector. Additionally or alternatively, if the fuel injector comprises a plurality of nozzles, the other nozzles may be shaped differently than the fuel injector nozzle 210.

Herein, the fuel injector nozzle 210 may be defined as a passage and/or opening of an injector shaped to expel a fluid out of the injector to a different component. For example, if the injector is a fuel injector, then the fuel injector nozzle 210 may function as an outlet of the fuel injector, wherein fuel flows through the fuel injector nozzle 210 and out of the fuel injector. In one example, the fuel injector nozzle 210 may define a nozzle opening of a fuel injector tip.

An axis system 280 is shown comprising three axes, namely an x-axis parallel to a horizontal direction, a y-axis parallel to a vertical direction, and a z-axis perpendicular to each of the x- and y-axes. A general direction of fuel mixture flow 292 may be substantially parallel to the y-axis. A central axis 299 of the fuel injector nozzle 210 may be parallel to each of the general direction of fuel mixture flow 292 and the y-axis.

The fuel injector nozzle 210 comprises a body 212 having an hourglass and/or venturi-shape. More specifically, the body 212 comprises a venturi inlet 220, a venturi outlet 230, and a venturi throat 240. Diameter 290 may be equal to a largest diameter of the venturi inlet 220 and the venturi outlet 230.

The venturi inlet 220 may comprise an inlet opening 222, which may correspond to the largest diameter of the venturi inlet. The inlet opening 222 may be shaped to receive a fuel mixture from a fuel sac or similar portion of a fuel injector. The venturi inlet 220 may constrict in a downstream direction, parallel to the general direction of fuel flow 292. Thus, the diameter of the venturi inlet 220 decreases as it approaches the venturi throat 240.

A fin 250 may be arranged in the venturi inlet 220. The fin 250 may extend from the inlet opening 222 to a beginning of the venturi throat 240 (e.g., dashed line 294). The fin 250 may twist relative to the central axis 299 of the body 212. A twist of the fin 250 may result in a leading edge 252 being offset with a trailing edge 254 by an angle, wherein the angle may be substantially equal to 90°. Thus, the leading edge 252 may be perpendicular to the trailing edge 254 due to a curvature of the fin 250.

The fin 250 may be physically coupled to a surface of the venturi inlet 220 for its entire length. As such, a first longitudinal side 256 may be in face-sharing contact with the surface of the venturi inlet 220, wherein the first longitudinal side 256 may be physically coupled to the surface of the venturi inlet 220 via one or more of welds, fusions, adhesives, and fasteners. A second longitudinal side 258 may be free from the surface of the venturi inlet 220 such that fuel may contact and travel along the second longitudinal side. A width 251 of the fin 250 may be measured from the first longitudinal side 256 to the second longitudinal side 258. In some examples, the width 251 may decrease in the downstream direction parallel to the general direction of fuel flow 292. In one example, the width 251 is substantially equal to a percentage of the diameter of the venturi inlet 220. The width 251 may be between 5 to 50% of the diameter of the venturi inlet. In some examples, additionally or alternatively, the width 251 may be between 20 to 45% of the diameter of the venturi inlet 220. In one example, the width 251 is 40% of the diameter of the venturi inlet.

Additionally or alternatively, the width 251 of the fin 250 may be substantially constant from the leading edge 252 to the trailing edge 254. As such, even though the venturi inlet 220 narrows toward the venturi throat 240, the fin 250 does not. In this way, a distance between the fin 250 and the central axis 299 may decrease in the general direction of fuel flow 292. By doing this, a likelihood of fuel contacting the fin 250 may increase as the fuel in the venturi inlet 220 approaches the venturi throat 220.

The venturi outlet 230 may be shaped similarly to the venturi inlet 220, except that the venturi outlet 230 increases in diameter in the downstream direction parallel to the general direction of fuel flow 292. In some examples, additionally or alternatively, a length, measured along the central axis 299, of the venturi outlet 230 may be equal to or different than a length of the venturi inlet 220. In one example, the length of the venturi outlet 230 is greater than the length of the venturi inlet 220. By elongating the venturi outlet 230 relative to the venturi inlet 220, combustion chamber gases and the fuel mixture may have a greater distance to mix. That is to say, if the fuel injector nozzle 210 comprises air entrainment features that direct air from a combustion chamber or other air source to the venturi throat 240, then the air and fuel may have a greater area to mix in before being injected into the combustion chamber, a fuel injector duct, or the like if the venturi outlet 230 is elongated relative to the venturi inlet 220.

The venturi outlet 240 may further comprise a fin 260. Herein, fin 250 may be referred to as upstream fin 250 and fin 260 may be referred to as downstream fin 260. The downstream fin 260 may be shaped identically to the upstream fin 250. As such, the downstream fin 260 may comprise a leading edge 262 arranged at an upstream extreme end of the venturi outlet 230 and a trailing edge 264 arranged at a downstream extreme end of the venturi outlet 230, wherein the downstream extreme end of the venturi outlet 230 comprises an opening 232 for expelling a fuel injection mixture into the combustion chamber or the like. The leading edge 262 may be perpendicular to the trailing edge 264. Additionally, the downstream fin 260 comprises a first longitudinal side 266 physically coupled to a surface of the venturi outlet 230. A second longitudinal side 268 opposite the first longitudinal side may come into contact with a fuel injection mixture.

A width 261 of the downstream fin 260 may be proportional to the diameter of the venturi outlet 230. That is to say, the width 261 may decrease as the diameter of the venturi outlet 230 decreases toward the venturi throat 240. Said another way, the width 261 of the downstream fin 260 increases in the general direction of fuel flow 292. In some examples, the width 261 is substantially equal to the width 251.

A difference between the upstream fin 250 and the downstream fin 260 may include their orientations. The downstream fin 260 may be arranged at an angle relative to the upstream fin 250. Said another way, the upstream fin 250 and the downstream fin 260 may be arranged at different radial positions such that leading edges and trailing edges of the fins do not align about the y-axis. In some examples, the angle may be between 1 to 90 degrees. In some examples, additionally or alternatively, the angle may be between 10 to 70 degrees. In some examples, additionally or alternatively, the angle may be between 30 to 60 degrees. In one example, the angle is exactly 45 degrees. In this way, the leading edge 262 of the downstream fin 260 may be offset by an angle of 45° relative to the leading edge 252 of the upstream fin 250. Similarly, the trailing edge 264 of the downstream fin 260 may be offset by an angle of 45° relative to the trailing edge 254 of the upstream fin 250.

Each of the upstream fin 250 and the downstream fin 260 may be oriented to direct a fuel mixture to swirl in a common direction. In the example of the FIG. 2, the upstream fin 250 and the downstream fin 260 are oriented to direct a fuel mixture to swirl in a counterclockwise direction. However, it will be appreciated by those of ordinary skill in the art that each of the upstream fin 250 and downstream fin 260 may be arranged to swirl the fuel mixture in a clockwise direction. In some examples, additionally or alternatively, the upstream fin 250 and the downstream fin 260 may be oriented to direct the fuel mixture to swirl in opposite directions. Thus, the upstream fin 250 may be oriented to direct the fuel mixture in a counterclockwise direction and the downstream fin 260 may be oriented to direct the fuel mixture in a clockwise direction or vice-versa.

The venturi throat 240 may be arranged between the trailing edge 254 of the upstream fin 250 and the leading edge 262 of the downstream fin 260. The venturi throat 240 may correspond to a smallest diameter of the body 212 of the fuel injector nozzle 210. The venturi throat 240 may be free of features and/or openings which may affect a fuel air mixture flow. In some embodiments, as shown in FIGS. 4 and 5, the venturi throat 240 may be fitted with one or more openings for flowing air from a combustion chamber thereto, such that air may at least partially mix with a fuel mixture before flowing to the venturi outlet 230.

In some examples, a diameter at the dashed line 294 (e.g., beginning of venturi throat 240) may be slightly less than a diameter at a dashed line 296 (e.g., ending of venturi throat 240). By doing this, mixing may improve, as will be described in greater detail below.

Turning now to FIG. 3A, it shows a top-down view 300 of the venturi inlet 220 with a fuel mixture, shown by arrows 302, flowing therethrough. The venturi inlet 220 is shown comprising a plurality of upstream fins 350, wherein each fin of the plurality of upstream fins 350 may be used similarly to the upstream fin 250. As such, components previously introduced may be similarly numbered in subsequent figures.

A number of the plurality of upstream fins 350 may be greater than two. In the example of FIG. 3A, the number of the plurality of upstream fins 350 is equal to four, however, it will be appreciated that the number may be equal to three, five, six, or more. Additionally, the plurality of upstream fins 350 may be arranged according to the number of fins arranged in the venturi inlet 220. For example, if eight fins are included in the venturi inlet 220, then the fins may comprise a twist of 45°, such that the leading and trailing edges are angled 45° to one another.

The leading edge 252 comprises a width greater than a width of a trailing edge 254 of the upstream fin 250. The width of the upstream fin 250 may decrease in the downstream direction to prevent constriction of the fuel injector nozzle and to prevent a collision between each of the upstream fins 350. First longitudinal side 256 may be curved as illustrated to provide the 90° twist to the upstream fin 250. The first longitudinal side 256 is physically coupled to the surface of the venturi inlet 220 and curves as it traverses down the venturi inlet 220 in a direction generally parallel to the general direction of fuel flow.

As the arrows 302 indicate, a fuel mixture may contact at least one of the upstream fins 350 adjacent the leading edge 252, wherein the fuel mixture may follow a curvature of the at least one upstream fin toward the venturi throat (e.g., venturi throat 240). The fuel mixture 302 may be directed to flow in a counterclockwise direction when contacting the upstream fins 350. In some examples, a fuel mixture may not contact the upstream fins 350. This may occur if the fuel mixture flows proximally to the central axis of the fuel injector nozzle, between the upstream fins 350. However, due to the swirl imparted onto the fuel mixture by the fins 350, it may be unlikely that a portion of the fuel mixture maintains a flow path substantially along the central axis without contacting the upstream fins 350 or downstream fin 260 of a plurality of downstream fins 360 shown in FIG. 3B.

Turning now to FIG. 3B, it shows a top-down view 301 of the venturi outlet 230 with a fuel mixture, shown by arrows 304, flowing therethrough. The venturi outlet 230 is shown comprising a plurality of downstream fins 360, wherein each fin of the plurality of downstream fins 360 may be used similarly to the downstream fin 260.

The leading edge 262 of the downstream fin 260 may comprise a width less than a width of the trailing edge 264. In one example, the leading edge 262 of the downstream fin 260 and the trailing edge 354 of the upstream fin 250 are substantially equal to each other. The width of the downstream fin 260 may increase in the downstream direction to increase an amount of fuel mixture it may contact without overly constricting a cross-section of the venturi outlet 230. The first longitudinal side 266 may be curved to provide the twist of the downstream fin 260 such that the leading edge 262 and the trailing edge 264 are 90° relative to one another.

As the arrows 304 indicate, the fuel mixture may contact at least one of the downstream fins 360 adjacent the leading edge 262, wherein the fuel mixture may follow a curvature of the at least one downstream fin toward an extreme end of the venturi outlet 230 where the fuel mixture may exit the venturi nozzle.

The top-down views 300 and 301 of FIGS. 3A and 3B are taken from a shared perspective down the central axis of the fuel injector nozzle to illustrate misalignment of the upstream fins 350 and the downstream fins 360. As shown, the downstream fin 360 may be angularly offset to the upstream fins 350, which may allow a greater amount of swirl to be imparted onto the fuel mixture. In one example, the angle is 45°, where the angle is measured between corresponding portions of the upstream and downstream fins. For example, the leading edge 252 of the upstream fin 250 is 45° offset to the leading edge 262 of the downstream fin 260. A halfway point of the upstream fin 250 is 45° offset to a halfway point of the downstream fin 260. The trailing edge 254 of the upstream fin 250 is 45° offset to the trailing edge 264 of the downstream fin 260. By doing this, a fuel mixture turbulence before entering a combustion chamber may be increased, which may decrease and/or prevent soot forming.

Turning now to FIG. 4, it shows an embodiment 400 of the fuel injector nozzle 210 comprising the venturi inlet 220 having the upstream fin 250, the venturi outlet 230 comprising the downstream fin 260, and the venturi throat 240 between the venturi inlet 220 and outlet 230. More specifically, boundaries of the venturi throat 240 are marked by dashed lines 402 and 404. Dashed line 402 indicates an upstream extreme end of the venturi throat 240 adjacent the venturi inlet 220. A fuel mixture may enter the venturi throat 240 at the upstream extreme end. Dashed line 404 indicates a downstream extreme end of the venturi throat 240 adjacent the venturi outlet 230. A fuel mixture may exit the venturi throat 240 at the downstream extreme 404 end and flow to the venturi outlet 230.

The embodiment 400 further comprises an air entrainment system 410 comprising an air entrainment passage 412 comprising an inlet 414 and an outlet 416. The air entrainment passage 412 may extend from the opening 232 of the venturi outlet 230 to the venturi inlet 240. As such, the air entrainment passage 412 may be coupled between the venturi inlet 220 and the venturi outlet 230. The air entrainment passage 412 may be arranged completely outside of the fuel injector nozzle 210 such that a fuel mixture does not come into contact with surface of the air entrainment passage 412.

As shown, the air entrainment system 410 comprises a plurality of the air entrainment passage 412 arranged around the fuel injector nozzle 210. In the example of FIG. 4, there are exactly two air entrainment passages. However, it will be appreciated that other numbers of the air entrainment passage 412 may be present, including only one or three or more without departing from the scope of the present disclosure.

Combustion chamber gases adjacent to the opening 232 of the venturi outlet 230 may enter the air entrainment passage 412 via the inlet 414. This may occur due to low static pressure at the venturi throat 440 due to a fuel mixture flowing therethrough being accelerated due to the venturi shape of the fuel injector nozzle 210. As such, combustion chamber gases may be promoted to flow through the air entrainment passage 412, out the outlet 416, and to the venturi throat 440 due to the venturi shape of the fuel injector nozzle 210. The combustion chamber gases (dashed arrows 494) may mix with a fuel mixture (arrows 492) in the venturi throat 440 and/or the venturi outlet 230. Due to the turbulence imparted by the upstream 250 and downstream 260 fins, mixing between the combustion chamber gases and the fuel mixture may increase relative to other injector nozzles in the art.

In some examples, the air entrainment system 410 may be additionally used as a fuel injection heating system. Gases from the combustion chamber may enter the air entrainment passage 412, wherein heat from the gases may transfer to fuel in the fuel injector nozzle 210. The heat may transfer while the gases are in the air entrainment passage 412 before the gases enter the fuel injector nozzle 210. In this way, the air entrainment system 410 may comprise two functions, heat the injection and to increase gas/injection mixing.

Turning now to FIG. 5, it shows an embodiment 500 of the fuel injector nozzle 210 comprising the venturi inlet 220 having the upstream fin 250, the venturi outlet 230 comprising the downstream fin 260, and the venturi throat 240 between the venturi inlet 220 and outlet 230. More specifically, boundaries of the venturi throat 240 are marked by dashed lines 502 and 504. Dashed line 502 indicates an upstream extreme end of the venturi throat 240 adjacent the venturi inlet 220. A fuel mixture may enter the venturi throat 240 at the upstream extreme end. Dashed line 504 indicates a downstream extreme end of the venturi throat 240 adjacent the venturi outlet 230. A fuel mixture may exit the venturi throat 240 at the downstream extreme end and flow to the venturi outlet 230.

The embodiment 500 further comprises an air entrainment system 510, wherein the air entrainment system comprises at least one air entrainment passage 512, an inlet 514, a chamber 516, and an annular outlet 518. The air entrainment passage 512 and the inlet 514 may be substantially similar to the air entrainment passage 412 and inlet 414 of FIG. 4. However, the air entrainment passage 512 may direction the combustion chamber gases (dashed arrows 594) to the chamber 516. The chamber 516 may extend around an entire circumference of the venturi throat 240. In this way, the chamber 516 may be an annular chamber. The chamber 516 may be hollow and may allow combustion chamber gases to flow therethrough before flowing out one or more outlets 518 and entering the venturi throat 240.

In some examples, the chamber 516 may be completely open to the venturi throat 240 such that combustion chamber gases may flow into the venturi throat 240 at any portion of its circumference via a single, continuous opening. Additionally or alternatively, the chamber 516 may comprise a plurality of openings fluidly coupling it to the venturi throat 240. The plurality of openings may be evenly spaced along the circumference of the venturi throat 240. In one example, the plurality of openings may include two openings separated by 180°. At any rate, the plurality of openings and/or the single, continuous opening may be shaped to flow combustion chamber gases into the venturi throat 240 in a radially inward direction perpendicular to the central axis 299.

The chamber 516 may comprise a trapezoidal cross-section. This may allow a diameter of the fuel injector nozzle at the dashed line 502 to be slightly smaller than a diameter of the fuel injector nozzle at the dashed line 504. Said another way, a portion of the venturi throat 240 directly upstream of the chamber 516 may comprise an upstream diameter smaller than a downstream diameter of a portion of the venturi throat 240 directly downstream of the chamber 516. In some examples, upstream diameter may be between 1 and 20% smaller than the downstream diameter. Additionally or alternatively, the upstream diameter may be between 5 and 15% smaller. In one example, the upstream diameter may be exactly 10% smaller than the downstream diameter. By doing this, combustion chamber gases mixing with the fuel mixture may increase.

Turning now to FIG. 6A, it shows a cross-sectional view an embodiment 600 of a fuel injector tip 610 comprising a plurality of nozzle holes 612. In one example, a nozzle hole of the plurality of nozzle holes 612 may be similar to the fuel injector nozzle 210 of FIGS. 2, 4, and 5. Additionally or alternatively, the nozzle hole of the plurality of nozzle holes 612 may be different than the fuel injector nozzle 210.

The plurality of nozzle holes 612 may include a central nozzle 620, a plurality of inner ring nozzles 630, a plurality of middle ring nozzles 640, and a plurality of outer ring nozzles 650. The central nozzle 620 may be arranged along a central axis 699 of the fuel injector tip. In some examples, the central axis 699 of the fuel injector tip 610 may align with a central axis of a fuel injector. In this way, the central nozzle 620 may be positioned to inject directly along an axis along which a piston oscillates.

The plurality of inner ring nozzles 630 may be arranged along a ring spaced about the central axis 699. A first diameter 632 of the ring of the plurality of inner ring nozzles 630 may be based on a second diameter 642 of the ring of the plurality of middle ring nozzles 640 and/or on a third diameter 652 of the ring of the outer ring nozzles 650. The third diameter 652 may be a greatest diameter, wherein the second diameter 642 is less than the third diameter 652 and where the first diameter 632 is less than the second diameter. In some examples, the second diameter 642 may be equal to between 50 to 90% of the third diameter 652. In some examples, additionally or alternatively, the second diameter 642 may be equal to 60 to 90% of the third diameter 652. In some examples, additionally or alternatively, the second diameter 642 may be equal to 70 to 90% of the third diameter 652. In some examples, additionally or alternatively, the second diameter 642 may be equal to 75 to 85% of the third diameter 652. In one example, the second diameter 642 is equal to 80% of the third diameter 652.

In some examples, the first diameter 632 may be equal to between 10 and 40% of the third diameter 652. In some examples, additionally or alternatively, the first diameter 632 may be equal to between 10 and 30% of the third diameter 652. In some examples, additionally or alternatively, the first diameter 632 may be equal to between 15 and 25% of the third diameter 652. In one example, the first diameter 632 is equal to 20% of the third diameter 652. In one exemplary embodiment, the third diameter 652 is 5 mm, the second diameter 642 is 4 mm, and the first diameter 632 is 2 mm. However, it will be appreciated that other dimensions may be used without departing from the scope of the present disclosure.

Nozzles of the inner 630, middle 640, and outer 650 ring nozzles may be angled differently relative to the central axis 699. The nozzles may be angled due to a curvature of the injector tip 610. For example, the injector tip 610 may be undulating and/or sinusoidal. By curving the injector tip 610, its package size may decrease and an orientation of the nozzles may be optimized to decrease penetration and decrease impingement.

A first angle 634 measured from an inner nozzle injection axis 636 to the central axis 699 may be between 10 and 50 degrees. In some examples, additionally or alternatively, the first angle 634 may be between 20 and 40 degrees. In some examples, additionally or alternatively, the first angle 634 may be between 25 and 35 degrees. In some examples, additionally or alternatively, the first angle 634 may be between 27 and 33 degrees. In one example, the first angle 634 is equal to 30 degrees.

A second angle 644 measured from a middle nozzle injection axis 646 to the central axis 699 may be between 0 and 30 degrees. In some examples, additionally or alternatively, the second angle 644 may be between 5 and 25 degrees. In some examples, additionally or alternatively, the second angle 644 may be between 5 and 20 degrees. In some examples, additionally or alternatively, the second angle 644 may be between 5 and 15 degrees. In some examples, additionally or alternatively, the second angle 644 may be between 5 and 10 degrees. In one example, the second angle 644 is equal to 5 degrees.

A third angle 654 measured from an outer nozzle injection axis 656 to the central axis 699 may be between 30 and 70 degrees. In some examples, additionally or alternatively, the third angle 654 may be between 35 and 65 degrees. In some examples, additionally or alternatively, the third angle 654 may be between 40 and 60 degrees. In some examples, additionally or alternatively, the third angle 654 may be between 45 and 55 degrees. In some examples, additionally or alternatively, the third angle 654 may be between 47 and 53 degrees. In one example, the third angle 654 is equal to 50 degrees.

As shown, the injector tip 610 may be symmetric about the central axis 699. In one example, the injector tip 610 is rotationally symmetric about the central axis 699. Additionally or alternatively, the injector tip 610 may also comprise reflectional symmetry about the central axis 699.

Turning now to FIG. 6B, it shows a view 602 of the injector tip 610 from within a combustion chamber. The view 602 further illustrates an arrangement of the inner 630, middle 640, and outer 650 ring nozzles. In the example of FIG. 6B, each of the inner 630, middle 640, and outer 650 ring nozzles may be radially aligned. In this way, the inner 630, middle 640, and outer 650 ring nozzles may be arranged such that they are concentric with one another relative to an injection axis of the central nozzle 620 (e.g., central axis 699 of FIG. 6A). In some examples, one or more of the inner 630, middle 640, and outer 650 ring nozzles may be radially misaligned with other nozzles without departing from the scope of the present disclosure.

The inner ring nozzles 630 may be arranged around a uniform circle sized according to the first diameter 632. The inner ring nozzles 630 may be evenly spaced about the uniform circle. Additionally or alternatively, one or more of the nozzles of the inner ring nozzles 630 may be unevenly spaced such that the distribution of the inner ring nozzles 630 is asymmetric. A number of inner ring nozzles 630 may be greater than two. Additionally or alternatively, the number of inner ring nozzles 630 may be greater than 6. Additionally or alternatively, the number of inner ring nozzles 630 may be greater than 8. Additionally or alternatively, the number of inner ring nozzles 630 may be greater than 10. In one example, the number of inner ring nozzles 630 is equal to 10.

The middle ring nozzles 640 may be arranged around a uniform circle sized according to the second diameter 642. The middle ring nozzles 640 may be evenly spaced about the uniform circle. Additionally or alternatively, one or more of the nozzles of the middle ring nozzles 640 may be unevenly spaced such that the distribution of the middle ring nozzles 640 is asymmetric. A number of middle ring nozzles 640 may be equal to a number of inner ring nozzles 630. Additionally or alternatively, the number of middle ring nozzles 640 may be less than or greater than the number of inner ring nozzles 630 without departing from the scope of the present disclosure.

The outer ring nozzles 650 may be arranged around a uniform circle sized according to the third diameter 652. The outer ring nozzles 650 may be evenly spaced about the uniform circle. Additionally or alternatively, one or more of the nozzles of the outer ring nozzles 650 may be unevenly spaced such that the distribution of the outer ring nozzles 650 may be asymmetric. A number of outer ring nozzles may be equal to a number of inner 630 and/or middle 640 ring nozzles. Additionally or alternatively, the number of outer ring nozzles 650 may be greater than the number of inner 630 and/or middle 640 ring nozzles. In one example, the number of outer ring nozzles 650 is exactly two times greater than the number of inner 630 and/or middle 640 ring nozzles. In one example of the injector tip 610, the number of inner ring nozzles 630 is equal to 10, the number of middle ring nozzles 640 is equal to 10, and the number of outer ring nozzles is equal to 20, wherein a first half of the outer ring nozzles 650 are radially aligned with the inner 630 and middle 640 ring nozzles, and a second half are evenly distributed between the first half.

A sizing of each nozzle of the inner 630, middle 640, and outer 650 ring nozzles and central nozzle 620 may be proportional relative to one another. For example, the inner ring nozzles 630 may be equally sized according to a first size, the central ring nozzle may be greater than or equal to the first size, the middle ring nozzles 640 may be equally sized to one another and may be greater than or equal to the first size, and the outer ring nozzles 650 may be equally sized to one another and may be greater than or equal to the first size. In some examples, the first size of the inner ring nozzles 630 may be between 0.01 to 0.05 mm. Additionally or alternatively, the first size of the inner ring nozzles 630 may be between 0.02 and 0.04 mm. In one example, the first size of the inner ring nozzles 630 is between 0.03 to 0.04 mm.

In some examples, the size of central nozzle 620 may be between 0.01 to 0.05 mm. Additionally or alternatively, the size of central nozzle 620 may be between 0.02 and 0.04 mm. In one example, the size of central nozzle 620 is 0.04 mm.

In some examples, the size of the middle ring nozzles 640 may be between 0.01 to 0.08 mm. Additionally or alternatively, the size of the middle ring nozzles 640 may be between 0.02 and 0.07 mm. Additionally or alternatively, the size of the middle ring nozzles 640 may be between 0.03 and 0.06 mm. Additionally or alternatively, the size of the middle ring nozzles 640 may be between 0.04 and 0.06 mm. In one example, the size of the middle ring nozzles 640 is between 0.05 to 0.06 mm.

In some examples, the size of the outer ring nozzles 650 may be between 0.01 to 0.07 mm. Additionally or alternatively, the size of the outer ring nozzles 650 may be between 0.02 and 0.07 mm. Additionally or alternatively, the size of the outer ring nozzles 650 may be between 0.03 and 0.06 mm. Additionally or alternatively, the size of the outer ring nozzles 650 may be between 0.04 and 0.06 mm. In one example, the size of the outer ring nozzles 650 is between 0.04 to 0.05 mm.

As such, the injector tip may be curved to angle its inner, middle, and outer ring nozzles relative to a single, central nozzle to decrease an amount of penetration of the fuel injection. Additionally, the shape of the injector tip 610 may increase its surface area, thereby decreasing injector packaging constraints. Furthermore, the sizing of the nozzles may be to decrease spray interactions and to decrease impingement of the fuel spray onto surfaces of the combustion chamber and/or piston.

In this way, a fuel injector nozzle may comprise one or more features to increase turbulence and mixing between a fuel injection mixture and combustion chamber gases. The fuel injector nozzle may comprise a venturi shaped with an upstream twisted fin arranged in a venturi inlet and a downstream twisted fin arranged in a venturi outlet. The upstream and downstream fins may impart a swirl onto the fuel mixture. The fuel injector nozzle may further comprise an air entrainment passage and/or chamber which may direct combustion chamber gases to a venturi throat of the venturi shaped nozzle hole. The combustion chamber gases may flow in a radially inward direction, which may further disrupt a flow direction of the fuel mixture, thereby increasing mixing and turbulence. The fuel injector nozzle may be one nozzle of a plurality of nozzles arranged along a curved injector tip. The technical effect of curving an injector tip is to decrease its packaging size, decrease interactions between sprays from separate nozzles, and to decrease impingement.

An embodiment of a system comprising an engine comprising an injector having a venturi-shaped nozzle, wherein the injector comprises a plurality of upstream twisted fins arranged in a venturi inlet, and where a leading edge of an upstream twisted fin of the plurality of upstream twisted fins is perpendicular to a trailing edge of the twisted fin. A first example of the system, further includes where the injector further comprises a plurality of downstream twisted fins arranged in a venturi outlet, and where the plurality of downstream twisted fins is identical to the plurality of upstream twisted fins in shape. A second example of the system, optionally including the first example, further includes where a leading edge of a downstream twisted fin of the plurality of downstream twisted fins is oriented at an angle relative to the leading edge of the upstream twisted fin of the upstream twisted fins. A third example of the system optionally including the first and/or second examples, further includes where the angle is equal to 45°. A fourth example of the system, optionally including one or more of the first through third examples, further includes where a width of each of the plurality of downstream twisted fins is equal to 40% of a diameter of the venturi outlet, and where the diameter of the venturi outlet increases in a downstream direction. A fifth example of the system, optionally including one or more of the first through fourth examples, further includes where a venturi throat is arranged between the venturi inlet and a venturi outlet, and where the upstream twisted fins do not extend into the venturi throat. A sixth example of the system, optionally including one or more of the first through fifth examples, further includes where a diameter of the venturi inlet decreases in a downstream direction, and where a width of each of the plurality of upstream twisted fins decreases in the downstream direction, and where the width is equal to 40% of the diameter of the venturi outlet. A seventh example of the system, optionally including one or more of the first through sixth examples, further includes where the plurality of upstream twisted fins is oriented to impart a counterclockwise or clockwise swirl onto a fuel mixture flow. An eighth example of the system, optionally including one or more of the first through seventh examples, further includes where the venturi-shaped nozzle is a single nozzle of a plurality of venturi-shaped nozzles evenly distributed along a surface of a tip of the injector, and where the surface is curved.

An embodiment of an injector comprising at least one injection nozzle comprising venturi throat arranged between a venturi inlet and a venturi outlet, and where the venturi inlet comprises at least one upstream twisted fin and the venturi outlet comprises at least one downstream twisted fin spaced away from the upstream twisted fin and an air entrainment system fluidly coupled to an extreme end of the venturi outlet and the venturi throat, and where the air entrainment system is arranged completely outside of the at least one injection nozzle. A first example of the injector further includes where the air entrainment system comprises two or more air entrainment passages directly fluidly coupled to the venturi throat. A second example of the injector, optionally including the first example, further includes where the air entrainment system comprises two or more air entrainment passages directly fluidly coupled to a chamber, where the chamber extends around an entire circumference of the venturi throat. A third example of the injector, optionally including the first and/or second examples, further includes where the chamber comprises two openings arranged 180° across from one another, the two openings fluidly coupling the chamber to the venturi throat. A fourth example of the injector, optionally including one or more of the first through third examples, further includes where the chamber comprises a trapezoidal cross-section, and where an upper diameter of the venturi outlet is larger than a lower diameter of the venturi inlet. A fifth example of the injector, optionally including one or more of the first through fourth examples, further includes where the at least one upstream twisted fin is one of four total upstream twisted fins, and where the at least one downstream twisted fin is one of four total downstream twisted fins, and where the downstream twisted fins and upstream twisted fins are angled and radially offset with one another.

A fuel injector comprising a curved tip comprising a central nozzle arranged along a central axis, a plurality of inner ring nozzles arranged around the central axis via a first diameter, a plurality of middle ring nozzles arranged around the central axis via a second diameter, and a plurality of outer ring nozzles arranged around the central axis via a third diameter, and where each of the pluralities of inner, middles, and outer ring nozzles are angled relative to the central axis. A first example of the fuel injector further includes where the first diameter is less than the second diameter, and where the second diameter is less than the third diameter, and where the inner ring nozzles are sized uniformly and evenly distributed, and where the middle ring nozzles are sized uniformly and evenly distributed, and where the outer ring nozzles are sized uniformly and evenly distributed. A second example of the fuel injector, optionally including the first example, further includes where the plurality of inner ring nozzles is smaller than the central nozzle, and where the central nozzle is smaller than each of the plurality of outer ring nozzles, and where the plurality of outer ring nozzles is smaller than each of the plurality of middle ring nozzles. A third example of the fuel injector, optionally including the first and/or second examples, further includes where a number of inner ring nozzles is equal to 10, and where a number of middle ring nozzles is equal to 10, and where a number of outer ring nozzles is equal to 10, and where the plurality of inner ring nozzles, the plurality of middle ring nozzles, and a first half of the plurality of outer ring nozzles are radially aligned, and where a second half of the plurality of outer ring nozzles are radially misaligned with the plurality of inner ring nozzles and the plurality of middle ring nozzles. A fourth example of the fuel injector, optionally including one or more of the first through third examples, further includes where one or more of the central nozzle and the pluralities of the inner, middle, and outer rings nozzles comprises a venturi throat arranged between a venturi inlet and a venturi outlet, and where the venturi inlet comprises at least one upstream twisted fin, and where the venturi outlet comprises at least one downstream twisted fin, and where the downstream twisted fin is misaligned with the upstream twisted fin relative to a general direction of fuel mixture flow.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first"

element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an injector having a venturi-shaped nozzle, wherein the nozzle comprises a plurality of upstream twisted fins arranged in a venturi inlet of the nozzle, and where a leading edge of an upstream twisted fin of the plurality of upstream twisted fins is perpendicular to a trailing edge of the upstream twisted fin, and further comprising a plurality of downstream twisted fins, wherein the pluralities of upstream and downstream twisted fins do not extend into a venturi throat.

2. The system of claim 1, wherein the nozzle further comprises the plurality of downstream twisted fins arranged in a venturi outlet of the nozzle, and where the plurality of downstream twisted fins is identical to the plurality of upstream twisted fins in shape.

3. The system of claim 2, wherein a leading edge of a downstream twisted fin of the plurality of downstream twisted fins is oriented at an angle relative to the leading edge of the upstream twisted fin of the plurality of upstream twisted fins.

4. The system of claim 3, wherein the angle is equal to 45°.

5. The system of claim 2, wherein a width of each of the plurality of downstream twisted fins is equal to 40% of a greatest diameter of the venturi outlet, and where a diameter of the venturi outlet increases in a downstream direction.

6. The system of claim 1, wherein a venturi throat of the nozzle is arranged between the venturi inlet and a venturi outlet, and where the plurality of upstream twisted fins do not extend into the venturi throat.

7. The system of claim 1, wherein a diameter of the venturi inlet decreases in a downstream direction, and where a width of each of the plurality of upstream twisted fins decreases in the downstream direction, and where the width is equal to 40% of a greatest diameter of a venturi outlet.

8. The system of claim 1, wherein the plurality of upstream twisted fins is oriented to impart a counterclockwise or clockwise swirl onto a fuel mixture flow.

9. The system of claim 1, wherein the venturi-shaped nozzle is a single nozzle of a plurality of venturi-shaped nozzles evenly distributed along a surface of a tip of the injector, and where the surface is curved.

10. An injector, comprising:

a tip including at least one injection nozzle comprising a venturi throat arranged between a venturi inlet and a venturi outlet, and where the venturi inlet comprises at least one upstream twisted fin and the venturi outlet comprises at least one downstream twisted fin spaced away from the at least one upstream twisted fin; and an air entrainment system fluidly coupled to an extreme end of the venturi outlet and the venturi throat, and where the air entrainment system is arranged completely outside of the at least one injection nozzle, wherein the air entrainment system comprises two or more air entrainment passages directly fluidly coupled to a chamber, where the chamber extends around an entire circumference of the venturi throat.

11. The injector of claim 10, wherein the air entrainment system comprises two or more air entrainment passages directly fluidly coupled to the venturi throat.

12. The injector of claim 10, wherein the chamber comprises two openings arranged in 180° across from one another, the two openings fluidly coupling the chamber to the venturi throat.

13. The injector of claim 10, wherein the chamber comprises a trapezoidal cross-section, and where an upper diameter of the venturi outlet is larger than a lower diameter of the venturi inlet.

14. The injector of claim 10, wherein the at least one upstream twisted fin is one of four total upstream twisted fins, and where the at least one downstream twisted fin is one of four total downstream twisted fins, and where the downstream twisted fins and upstream twisted fins are angled and radially offset with one another.

15. A fuel injector, comprising:

a curved tip comprising a central nozzle arranged along a central axis, a plurality of inner ring nozzles arranged around the central axis via a first diameter, a plurality of middle ring nozzles arranged around the central axis via a second diameter, and a plurality of outer ring nozzles arranged around the central axis via a third diameter, and where each of the pluralities of inner, middle, and outer ring nozzles are angled relative to the central axis, wherein one or more of the central nozzle and the pluralities of inner, middle, and outer rings nozzles comprises a venturi throat arranged between a venturi inlet and a venturi outlet, and where the venturi inlet comprises at least one upstream twisted fin, and where the venturi outlet comprises at least one downstream twisted fin, and where the at least one downstream twisted fin is misaligned with the at least one upstream twisted fin relative to a general direction of fuel mixture flow.

16. The fuel injector of claim 15, wherein the first diameter is less than the second diameter, and where the second diameter is less than the third diameter, and where the inner ring nozzles are sized uniformly and evenly distributed, and where the middle ring nozzles are sized uniformly and evenly distributed, and where the outer ring nozzles are sized uniformly and evenly distributed.

17. The fuel injector of claim 15, wherein the plurality of inner ring nozzles is smaller than the central nozzle, and where the central nozzle is smaller than each of the plurality of outer ring nozzles, and where the plurality of outer ring nozzles is smaller than each of the plurality of middle ring nozzles.

18. The fuel injector of claim 15, wherein a number of the plurality of inner ring nozzles is equal to 10, and where a number of the plurality of middle ring nozzles is equal to 10, and where a number of the plurality of outer ring nozzles is equal to 10, and where the plurality of inner ring nozzles, the plurality of middle ring nozzles, and a first half of the plurality of outer ring nozzles are radially aligned, and where a second half of the plurality of outer ring nozzles are radially misaligned with the plurality of inner ring nozzles and the plurality of middle ring nozzles.

* * * * *